US007393026B2

(12) United States Patent
Ikeda et al.

(10) Patent No.: US 7,393,026 B2
(45) Date of Patent: Jul. 1, 2008

(54) LOCK MECHANISM AND LATCH DEVICE

(75) Inventors: Yasuhiko Ikeda, Toyonaka (JP); Yasushi Ueki, Yokohama (JP); Shigemitsu Tomita, Yokohama (JP)

(73) Assignee: NIFCO Inc., Yokohama-Shi, Kanagawa (JP)

( * ) Notice: Subject to any disclaimer, the term of this patent is extended or adjusted under 35 U.S.C. 154(b) by 0 days.

(21) Appl. No.: 11/433,567

(22) Filed: May 15, 2006

(65) Prior Publication Data

US 2006/0258220 A1 Nov. 16, 2006

(30) Foreign Application Priority Data

May 13, 2005 (JP) ..... 2005-141721

(51) Int. Cl.
*E05B 15/02* (2006.01)

(52) U.S. Cl. ..... 292/341.15; 292/DIG. 4

(58) Field of Classification Search ..... 292/341.15, 292/6, DIG. 4 X
See application file for complete search history.

(56) References Cited

U.S. PATENT DOCUMENTS 5,217,262 A * 6/1993 Kurosaki ..... 292/6

FOREIGN PATENT DOCUMENTS

| | | |
|---|---|---|
| JP | 3072911 | 2/2000 |
| JP | 3126992 | 11/2000 |
| JP | 2004-137725 | 5/2004 |

* cited by examiner

*Primary Examiner*—Patricia Engle
*Assistant Examiner*—Mark Williams
(74) *Attorney, Agent, or Firm*—Manabu Kanesaka

(57) ABSTRACT

A lock mechanism holds a moving member on a main body immovably in a locked state and allows movement in an unlocked state. The lock mechanism includes a circulating cam groove formed on the main body or the moving member, and a trace member having an angle bracket shape with one and the other trace parts to sway on the main body or moving member. The one trace part circulates along the circulating cam groove in each approaching and moving away operation of the moving member, and locks the moving member in a state having coupled with the coupling part. A wall surface is formed on the main body or moving member to be disposed in a different position from the circulating cam groove so that the other trace part of the trace member is operable to contact the wall surface only in the locked state of the moving member.

13 Claims, 12 Drawing Sheets

LOCK MECHANISM AND LATCH DEVICE

BACKGROUND OF THE INVENTION AND RELATED-ART STATEMENT

The present invention relates to a lock mechanism, and a latch device, which has a moving member that is capable of approaching and moving away from a main body, and holds said moving member to be immovable in the locked position and enables movement in the unlocked state.

In vehicle compartment internal accessories such as cup holders and ashtrays, and audio devices., and the like, some have latch devices in order to close an opening-and-closing lid. For example, in Japanese Patent No. 3126992, a pair of circulating cam grooves having mutually different shapes is formed on both sides of a latch body 16. Also, the base part of a trace member is fixed on a housing, and a pair of trace parts formed on a trace part of the trace member is made capable of tracing respectively following the pair of circulating cam grooves.

These trace parts are pushed by the groove wall surface of the circulating cam groove in each pushing-in operation of the latch body, but because the shapes of the circulating cam grooves differ between the front side and the back side of the latch body, twisting is caused in the trace member. The trace parts are made to circulate in a fixed direction by the recoil force of the trace member against this twisting force.

Also, the latch body becomes in a state being locked to the housing in a state in which the trace parts are coupled respectively in recessed parts formed respectively on the circulating cam grooves. By this, the lock strength can be made higher compared with the case of one trace part.

However, in Japanese Patent No. 3126992, because the trace parts are made to circulate by twisting force on the trace member, the durability of the trace member is not good.

The present invention, in consideration of the above circumstances, aims to provide a lock mechanism, and a latch device, in which the trace member can be made to circulate following the circulating cam groove without utilizing twisting force on the trace member.

Further objects and advantages of the invention will be apparent from the-following description of the invention.

SUMMARY OF THE INVENTION

In a first aspect of the invention, a lock mechanism has a moving member that is capable of approaching and moving away from a main body, and holds the moving member to be immovable in the locked position and enabling movement in the unlocked state. The lock mechanism comprises a circulating cam groove, which is formed on said main body; a trace member, which is formed roughly in an angle bracket shape and is provided to be capable of swaying on said moving member, and of which one trace part circulates following said circulating cam groove in each approaching and moving away operation of said moving member and locks the moving member in a state having coupled with a coupling part provided in the circulating cam groove; and-a wall surface, which is provided in a different position from said circulating cam groove on said main body, and another trace part of said trace member becomes able to contact it only in the locked state of said moving member.

Furthermore, the circulating cam groove is formed on the main body. Meanwhile, the roughly bracket-shaped trace member is provided on the moving member, which is capable of approaching and moving away from the main body. Of this trace member, one trace part circulates following the circulating cam groove in each approaching and moving away operation of the moving member. Also, the one trace part locks the moving member in a state having coupled in the coupling part provided in the circulating cam groove.

Also, on the main body, the wall surface is provided in a different position from the circulating cam groove, and the other trace part of the trace member becomes able to contact it only in the locked state of the moving member.

That is, when the one trace part of the trace member circulates following the circulating cam groove, because the other trace part does not contact the wall surface, it comes to circulate in the same form as the circulating cam groove together with the one trace part. Therefore, there is no occurrence of twisting force on the trace member.

Because it is not the case that the trace part is made to circulate by causing twisting force on the trace member, there is no requirement for high measurement precision in the circulating cam groove, and the mold expense can be reduced. Also, because twisting force is not caused on the trace member, the durability of the trace member can be improved.

Also, by making it such that a gap is provided at least between the other trace part and the main body, the sliding resistance caused in circulation of the trace part of the trace member comes to be caused only between the one trace part and the wall surface of the circulating cam groove. Therefore, because only roughly the same sliding resistance as in the case when only one trace part is used is caused, regardless of the fact that two trace parts are being used, smooth operation can be obtained.

Furthermore, in the locked state of the moving member, because the locked state of the moving member can be held by two trace parts, not only with the one trace part of the trace member coupling with the coupling part of the circulating cam groove, but also with the other trace part contacting the wall surface, the lock strength can be improved compared with the case when the locked state is held by one trace part.

In a second aspect, the lock mechanism includes a moving member that is capable of approaching and moving away from a main body, and holds the moving member to be immovable in the locked position and enabling movement in the unlocked state. The lock mechanism comprises a circulating cam groove, which is formed on said moving member; a trace member, which is formed roughly in an angle bracket shape and is provided to be capable of swaying on said main body, and of which one trace part circulates following said circulating cam groove in each approaching and moving away operation of said moving member and locks the moving member in a state having coupled with a coupling part provided in the circulating cam groove; and a wall surface, which is provided in a different position from said circulating cam groove on said moving member, and another trace part of said trace member becomes able to contact it only in the locked state of said moving member.

Still referring to the second aspect, the circulating cam groove and the wall surface are provided on the moving member and the trace member is provided on the main body to obtain approximately the same effect as the lock mechanism of the first aspect.

In a third aspect of the lock mechanism, the other trace part of said trace member contacts said wall surface when a force is further applied toward a direction moving said moving member away from said main body from the locked state of the moving member.

Further regarding the lock mechanism of the third aspect, in the normally locked state of the moving member, the other trace part of the trace member does not contact the wall surface, but when a force is further applied toward a direction moving the moving member away from the main body from this state, the other trace part contacts the wall surface so as not to allow the moving member to move away from the main body.

That is, by making the lock strength in two levels, during normal use the lock strength of the moving member can be made lighter.

In a fourth aspect of a lock mechanism, the circulating cam groove is roughly heart shaped, and the coupling part of the circulating cam groove is a recessed part.

In a fifth aspect of a lock mechanism, the trace member is an elastically deformable metal pin.

In a sixth aspect, a latch device has a latch body that is inserted into a roughly box-shaped housing and is forced toward the pulling-out direction. The latch device comprises a circulating cam groove, which is formed on one side of said latch body; a trace member, which is formed roughly in an angle bracket shape and is provided to be capable of swaying on said housing, and of which one trace part circulates following said circulating cam groove in each pushing-in operation of said latch body and locks the latch body in a state having coupled with a coupling part provided in the circulating cam groove; and a wall surface, which is formed on another side of said latch body, and another trace part of said trace member becomes able to contact it only in the locked state of said latch body.

The circulating cam groove of the sixth aspect is formed on one side of the latch body. Meanwhile, the roughly angle bracket-shaped trace member is provided to be capable of swaying on the housing into which the latch body is inserted. Of this trace member, the one trace part of the trace member circulates following the circulating cam groove in each pushing-in operation of the latch body. Also, the one trace part locks the latch body in a state having coupled with the coupling part provided in the circulating cam groove.

Furthermore, the wall surface is provided on the other side of the latch body, and the other trace part of the trace member becomes able to contact it only in the locked state of the latch body, and an effect similar to that of the first aspect can be obtained.

A seventh aspect of the latch device is similar to the sixth aspect, wherein the other trace part of the trace member contacts the wall surface when a force is further applied toward the pulling-out direction of the latch body from the locked state of the latch body. By this, roughly the same effect as the effect recited in the second aspect can be obtained.

An eighth aspect of the latch device is similar to the sixth or seventh aspect, wherein the circulating cam groove is roughly heart shaped, and the coupling part of the circulating cam groove is a recessed part.

The ninth aspect of the latch device may be similar to the sixth through eighth aspects, wherein the trace member is an elastically deformable metal pin.

In a tenth aspect, a lock mechanism comprises: a locking claw, which is provided on the housing of the latch device recited in any of sixth to ninth aspects, and is locked in a hole part formed on a first member; gripping parts, which are provided to be capable of approaching and moving away from each other on the front end part of the latch body of said. latch device, and become in a closed state being housed inside the housing in the locked state of the latch body, and become in an open state during unlocking of the latch body; a second member, which relatively approaches and moves away from said first member; and a gripped part, which is provided on said second member, and is gripped by said gripping parts in the locked state of the latch body, and is released from the gripped state of the gripping parts during unlocking.

In the tenth aspect, the locking claw is provided on the housing of the latch device, and it is locked in the hole part formed on the first member. Also, the gripping parts which become capable of approaching and moving away from each other are provided on the front end part of the latch body of the latch device, they become in the closed state housed inside the housing in the locked state of the latch body, and they become in the open state during unlocking of the latch body.

Meanwhile, the gripped part is provided on the second member which relatively approaches and moves away from the first member, it is gripped by the gripping parts in the locked state of the latch body, and it is released from the gripped state of the gripping parts during unlocking.

Because the present invention is made of the above constitution, when the one trace part of the trace member circulates following the circulating cam groove, the other trace part does not contact the wall surface, and therefore there is no occurrence of twisting force on the trace member, there is no requirement for high measurement precision in the circulating cam groove, and the mold expense can be reduced. Also, because twisting force is not caused on the trace member, the durability of the trace member can be improved. Furthermore, because only roughly the same sliding resistance as in the case when only one trace part is used is caused, regardless of the fact that two trace parts are being used, smooth operation can be obtained. Also, because the locked state of the moving member can be held by two trace parts, the lock strength can be improved compared with the case when the locked state is held by one trace part.

DETAILED DESCRIPTION OF PREFERRED EMBODIMENTS

Figure 1:
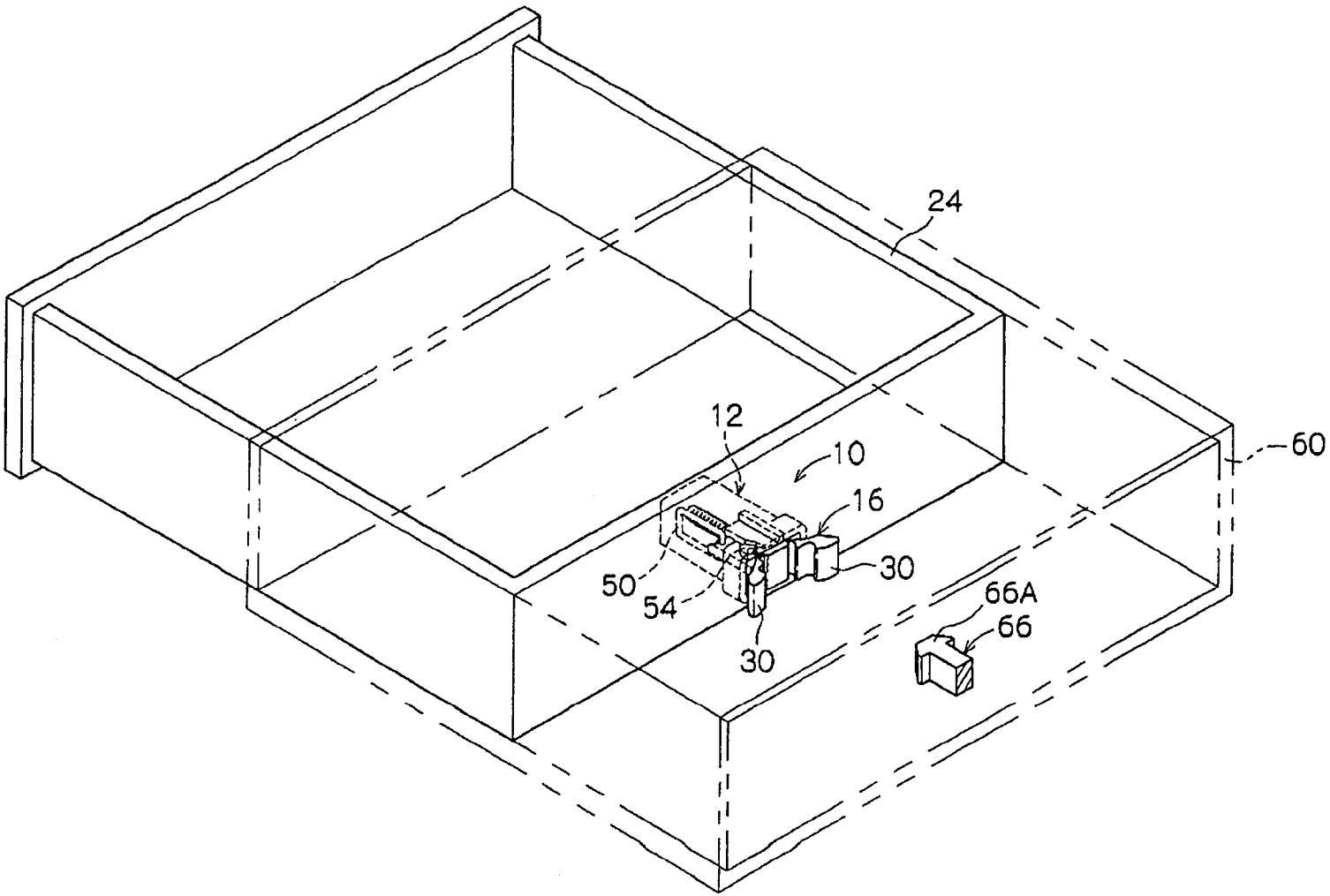
FIG. 1 is a perspective view showing the state in which the latch device and striker pertaining to a mode of working of the present invention are respectively attached.

A latch device pertaining to a mode of working of the present invention is now explained.

As shown in FIG. 1 through FIGS. 4(A) and (B), the latch device 10 has a box-shaped housing 12, and an opening 14 is formed on one end in the lengthwise direction. The latch body 16 is made capable of being housed inside this housing 12, and the latch body 16 is inserted from the opening 14.

A gripping piece 30 sticking outward is provided on the front end part of the latch body 16, and a hinge part 32 is provided on the base part of the gripping piece 30 so that it is made capable of elastic deformation. By this, the gripping piece 30 becomes capable of approaching and moving away from itself.

Also, the base part 34 of the latch body 16 is roughly parallelepiped-shaped, and in FIG. 4(A), a circular hole 36 is formed on the left side of the base part 34 following the lengthwise direction from the bottom surface of the base part 34. A compression coil spring 38 is made capable of being received inside this circular hole 36.

One end part of the compression coil spring 38 contacts the back wall of the circular hole 36, and the other end of the compression coil spring 38 is made capable of contacting the bottom part of the housing 12. A bar-shaped spring bearing 40 is placed upright on the bottom part of the housing 12, and the compression coil spring 38 is received inside the circular hole 36 in a state having been fitted around the outside of the spring bearing 40. By this, the latch body 16 becomes in a state regularly being forced toward the direction of pulling out from the housing 12 by the compression coil spring 38 while in a state being housed inside the housing 12.

Figure 3:
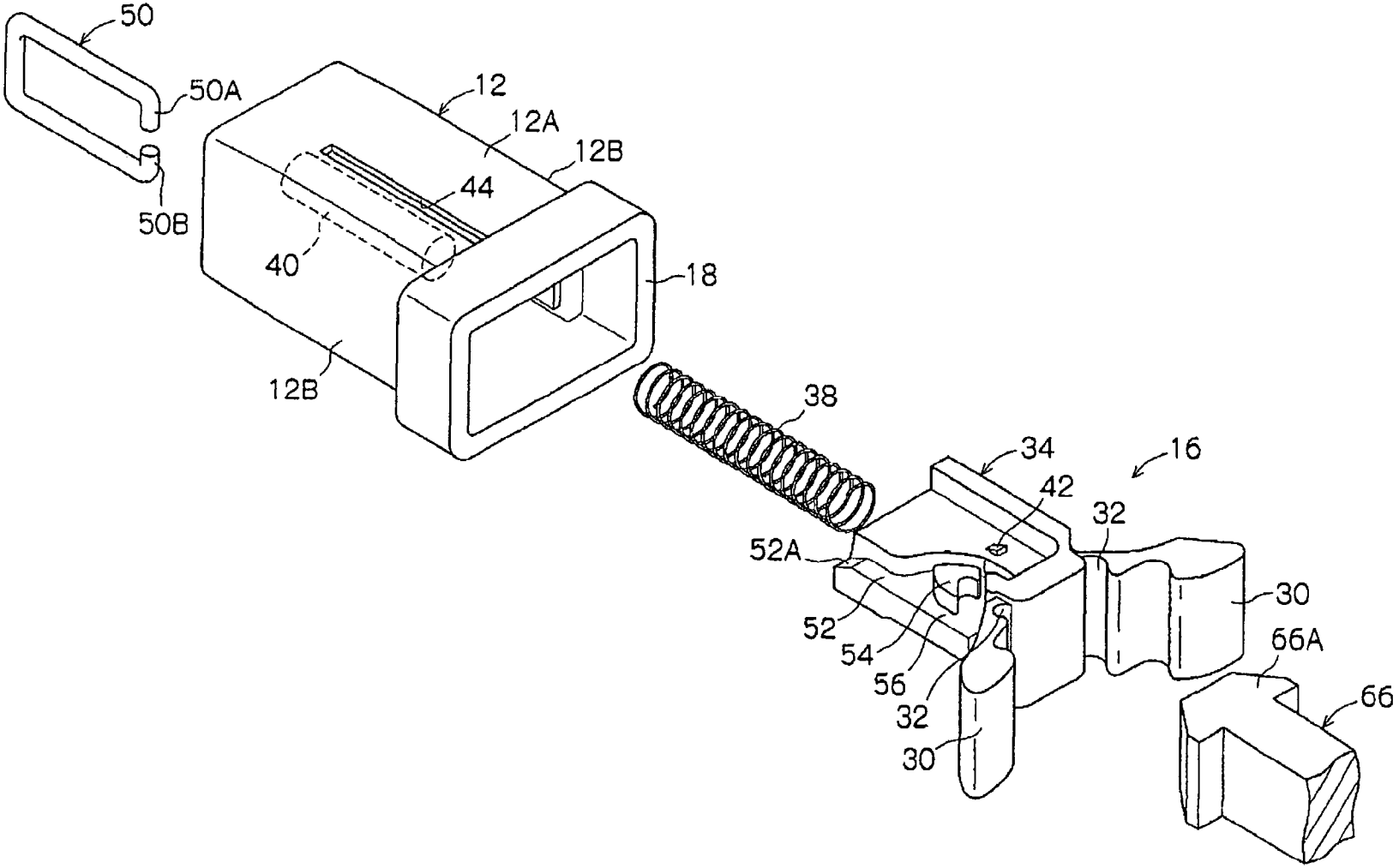
FIG. 3 is an exploded perspective view showing the latch device and striker pertaining to a mode of working of the present invention.
Figure 4:
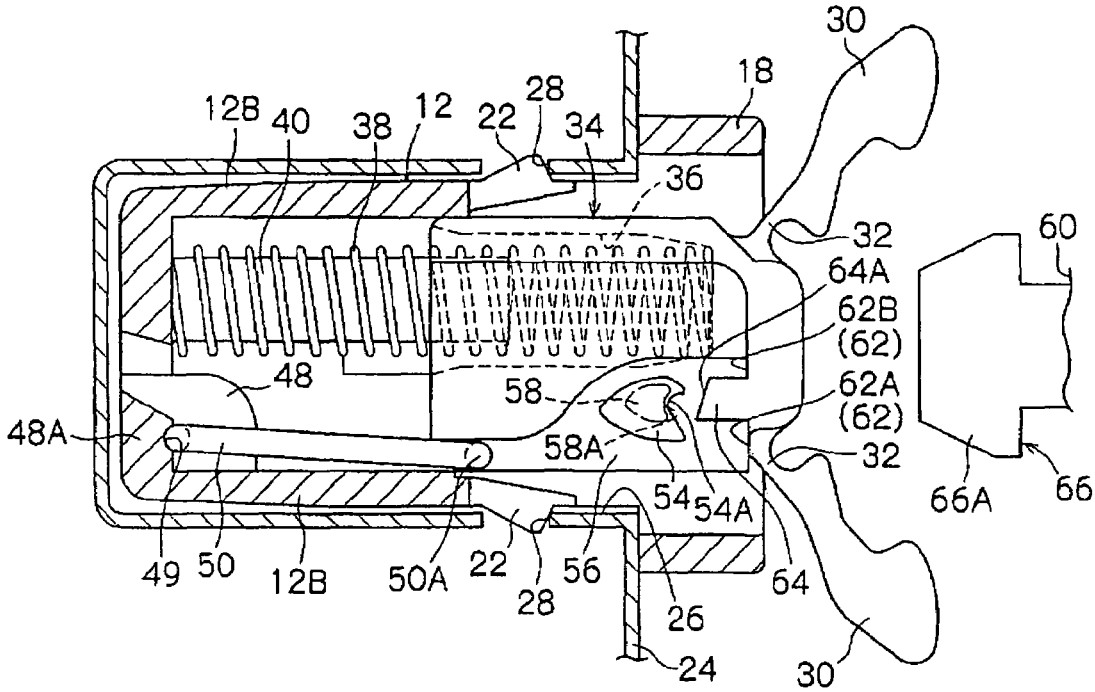
FIG. 4(A) is a sectional view showing the unlocked state of the latch body of the latch device pertaining to a mode of working of the present invention.
FIG. 4(B) is a sectional view showing the locked state of the latch body.
Figure 4:
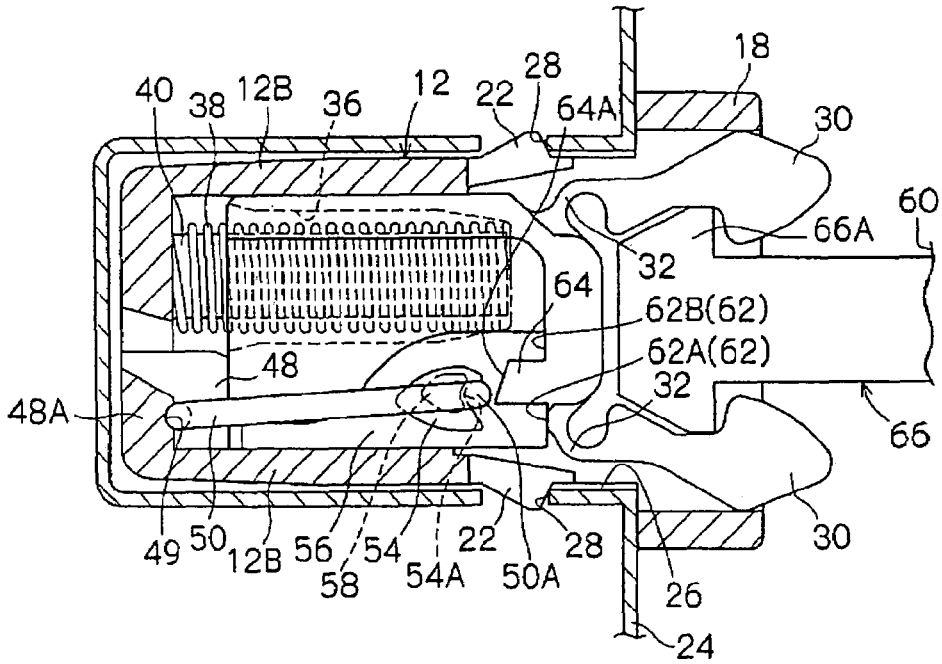

Here, as shown in FIG. 3, a bump 42 is placed protruding on the left side surface of the base part 34. Meanwhile, a long hole 44 capable of coupling with the bump 42 is formed on the wall surface 12A of the housing 12. The bump 42 after coupling with the long hole 44 becomes capable of moving following the long hole 44. By this, movement of the latch body 16 against the housing 12 is allowed, while the latch body 16 is prevented from being completely pulled out from the housing 12.

Meanwhile, a rectangular frame 18 is provided on the opening 14 side of the housing 12, and it sticks out from a wall surface 12A of the housing 12 and a pair of wall surfaces 12B orthogonal to the wall surface 12A. From the wall surface 12B, as shown in FIGS. 4(A) and 4(B), a locking claw 22 is placed protruding, and it is made capable of elastic deformation toward the inside of the wall surface 12B.

The housing 12 is made capable of attachment to opening-and-closing lids of audio devices, and the like, and cup holders and ashtrays inside vehicle compartments, and the like, and here, as one example it is made to be attached on the back surface of a box-shaped attachment member 24 (see FIG. 1).

A receiving recessed part 26 into which the housing 12 is capable of being received is provided on the back surface of this attachment member 24, and it is made such that the rectangular frame 18 contacts the perimeter part of the receiving recessed part 26. Also, a locking hole 28 into which the locking claw 22 is capable of locking is formed inside the receiving recessed part 26, and the housing 12 is fixed to the attachment member 24 in the locked state of the locking claw 22.

Figure 5:
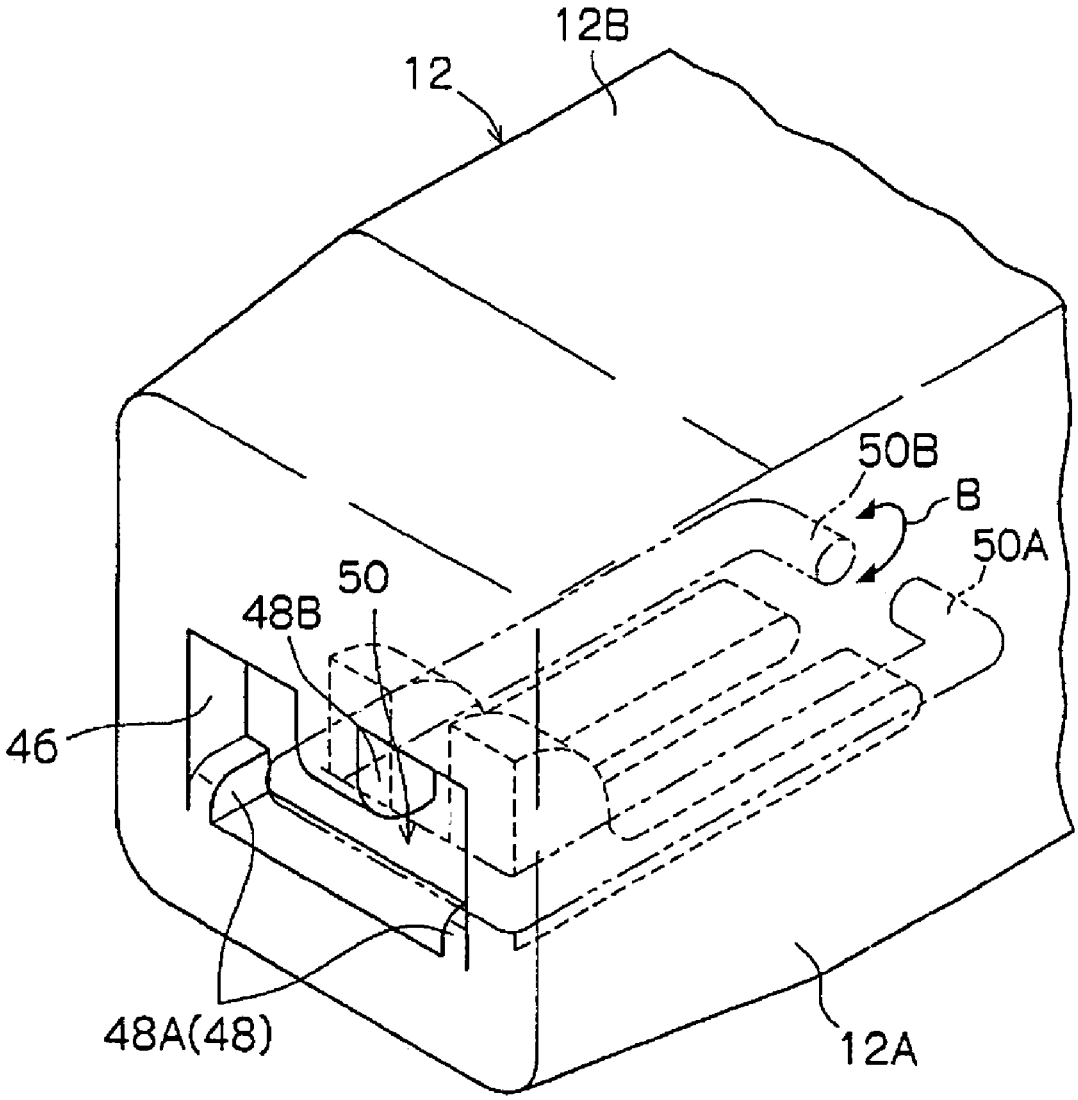
FIG. 5 is a perspective view from the underside of the housing of the latch device pertaining to a mode of working of the present invention.

Incidentally, as shown in FIG. 5 (FIG. 5 is a drawing viewing FIG. 4(A) from a direction rotated 90°), an insertion hole 46 is formed on the bottom part of the housing 12, and a locking part 48 constituted by locking pieces 48A and 48B which protrude in mutually different manners is provided on the perimeter part of the insertion hole 46.

A coupling recessed part 49 is formed on the base part of this locking piece 48A, and it is made capable of coupling with a roughly angle bracket-shaped trace member 50 having a shape as if having cut out a part of a side composing the rectangular shape. The trace member 50 is formed with elastically deformable metal, and it is held to be capable of swaying in the direction of arrow A with the coupling part 48 as fulcrum. The front end part of this trace member 50 is made as trace parts 50A and 50B, and they are formed so that the front end surfaces face each other.

Figure 2:
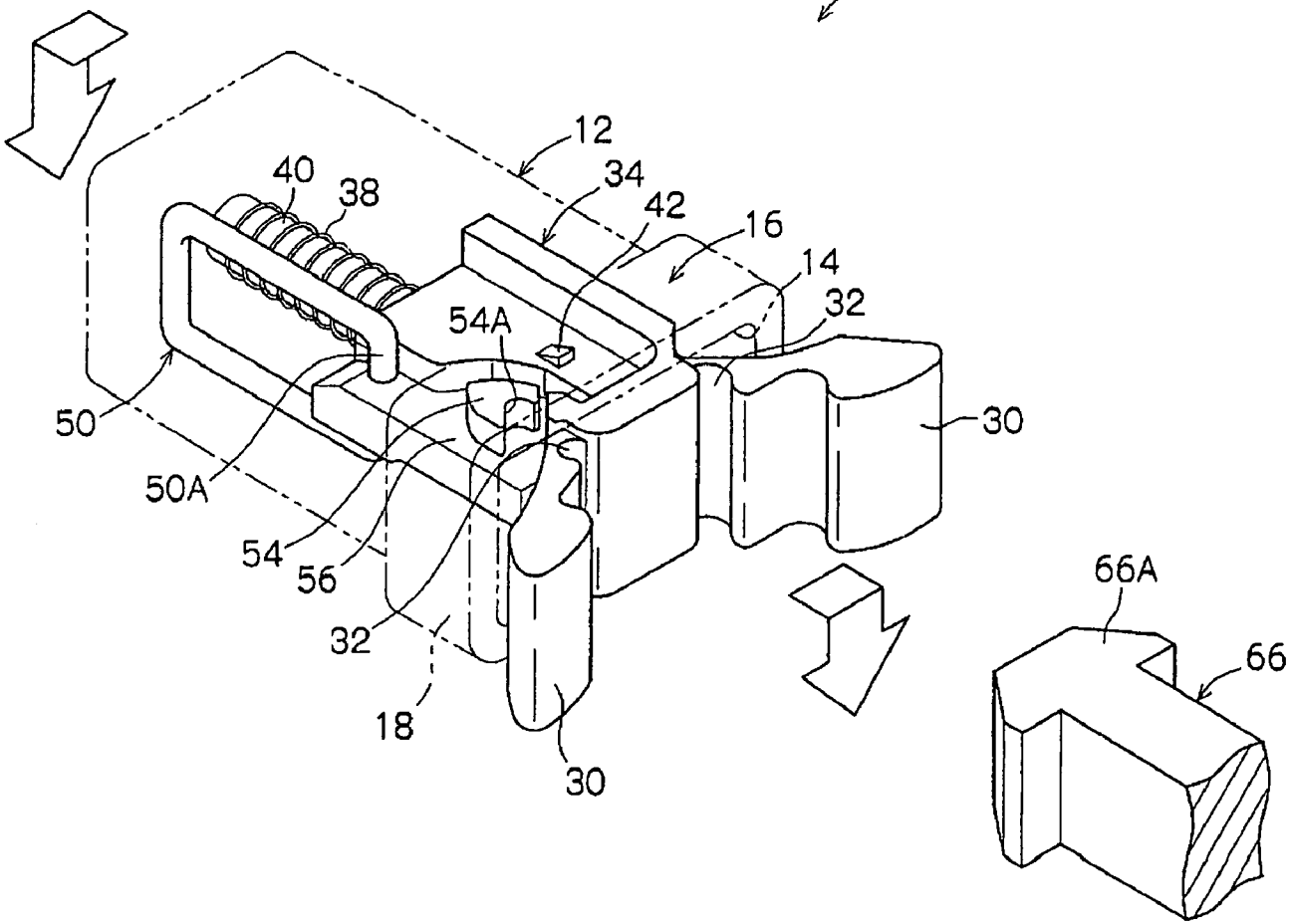
FIG. 2 is a perspective view showing the latch device and striker pertaining to a mode of working of the present invention.

Meanwhile, as shown in FIG. 2 and FIG. 3, on the right side of the base part 34 of the latch body 16, there is provided a thin part 52, having been made thin by providing a stepping from the plane level of the left side surface of the base part 34, and the trace parts 50A and 50B are made capable of facing it. Here, a pair of inclined parts 52A is provided on the end surface of the thin part 52 so that the end surface of the thin part 52 becomes thin tipped whereby the trace parts 50A and 50B become easier to couple.

Figure 6:
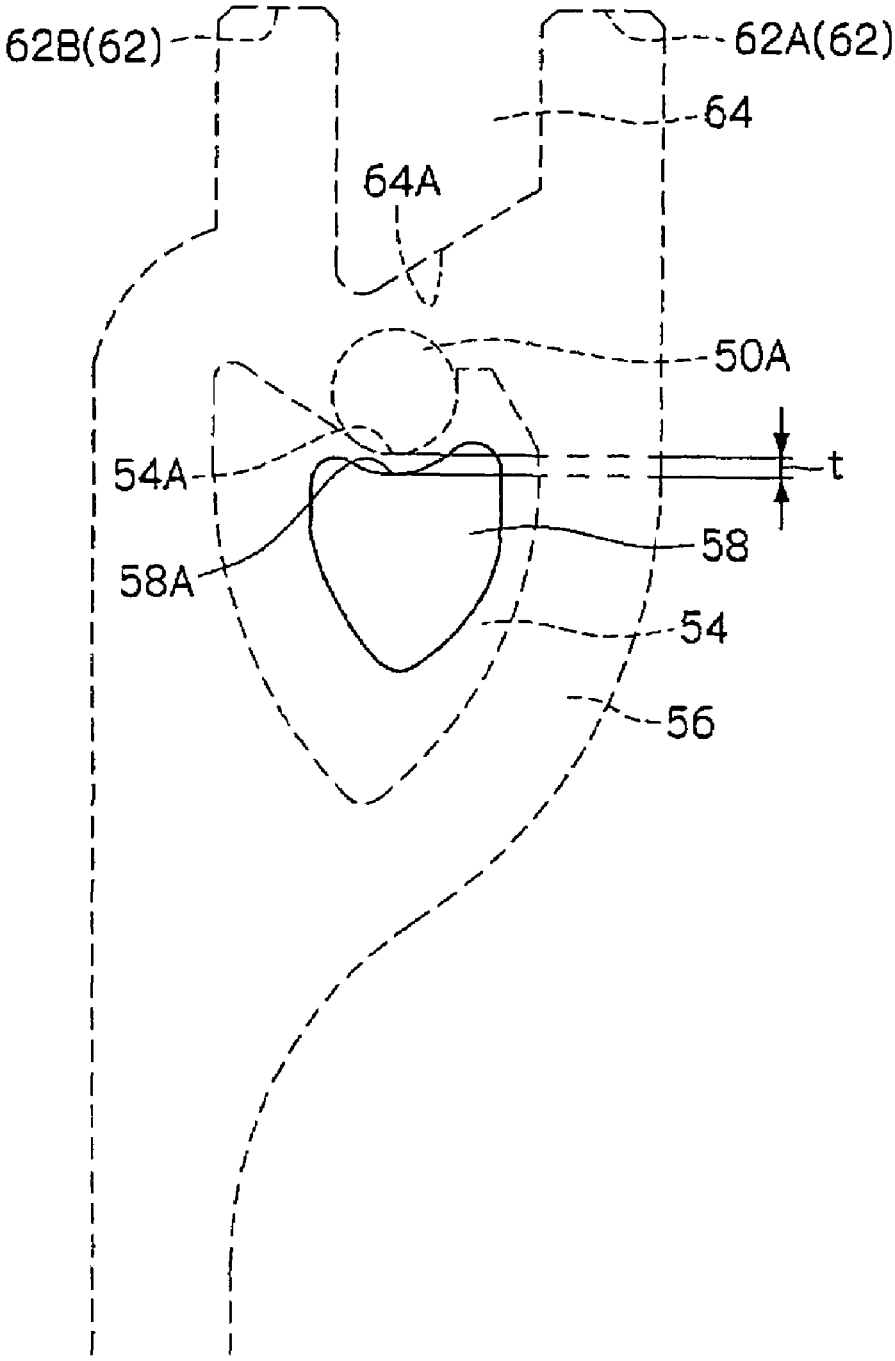
FIG. 6 is a plan view showing the coupled state of the circulating cam groove and the trace part of the latch device pertaining to a mode of working of the present invention.

Also, a roughly heart-shaped cam part 54 is placed protruding on the side that the trace part 50A faces, and on the side that the trace part 50B faces, as shown in FIG. 6, there is placed a roughly heart-shaped protruding part 58, being positioned inside the cam part 54 viewing as a plane and being made smaller than the external shape of the cam part 54.

Also, on the thin part 52, a stopper wall 62 facing opposite the cam part 54 is placed upright on the side of the gripping piece 30 (see FIG. 4(A)), and a cam wall 64 protruding from the stopper wall 62 leaving the two ends (stopper parts 62A, 62B) of the stopper wall 62 is provided in a position facing opposite the recessed part 54A of the cam part 54. The cam surface 64A of this cam wall 64 facing opposite the recessed part 54A is formed in a state being inclined against the stopper wall 62, and it guides the trace part 50A.

As shown in FIGS. 4(A) and 4(B), when the latch body 16 is pressed in a direction opposing the force of the compression coil spring 38 and is pushed into the housing 12, the pair of gripping pieces 30 contacts the inner surface of the rectangular frame 18 of the housing 12, and they are elastically deformed toward the direction of approaching each other (closing). At this time, the trace part 50A moves while swaying following the shape of the circulating cam groove 56 constituting the cam wall 54. At this time, the trace part 50B does not contact the protruding part 58.

Figure 8:
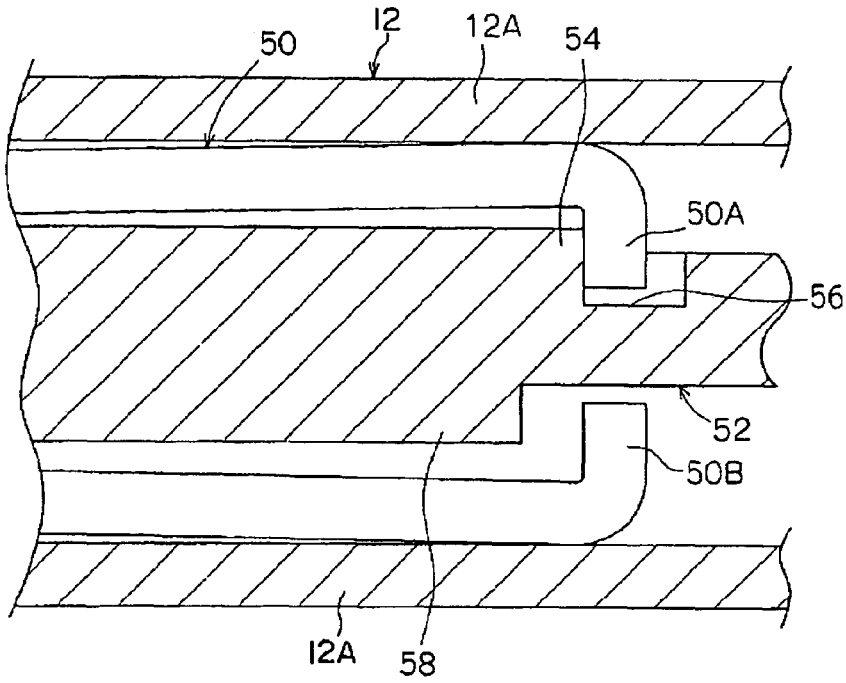
FIGS. 8(A) and 8(B) are sectional views showing the coupled state of the circulating cam groove and the trace part of the latch device pertaining to a mode of working of the present invention.
Figure 8:
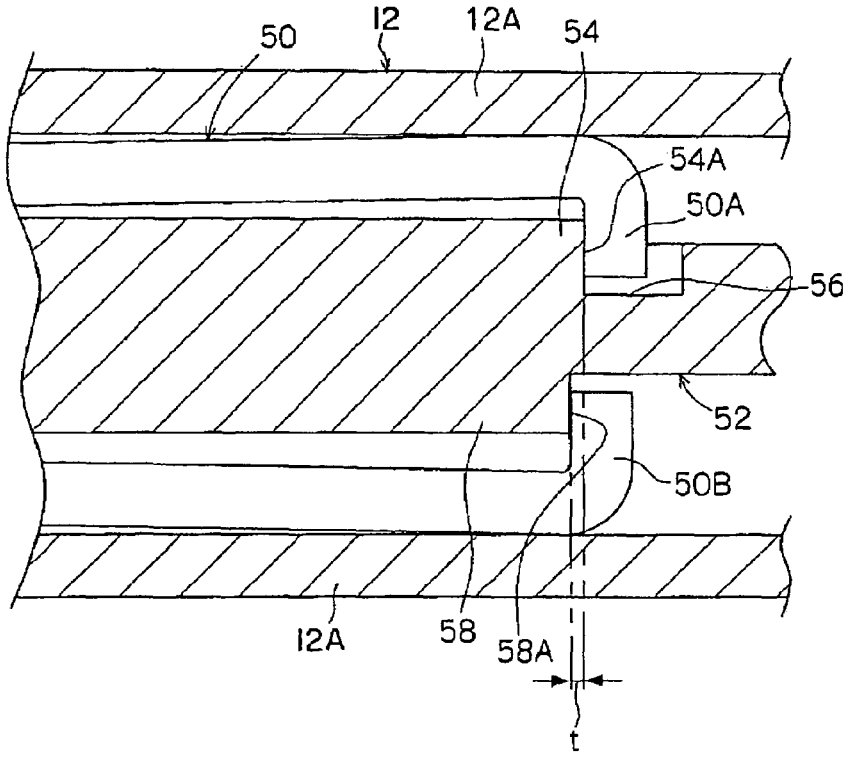

Meanwhile, as shown in FIG. 8(A), the trace member 50 is open slightly toward the direction of moving away from itself going toward the sides of the trace parts 50A and 50B, and the side of the trace parts 50A and 50B of the trace member 50 contacts the inner surface of the wall surface 12A of the housing 12 so that the trace parts 50A and 50B do not come off from the thin part 52.

Here, the distance of separation between the outer surfaces on the side of the trace parts 50A and 50B of the trace member 50 is made larger than the distance of separation between the inner surfaces of the wall surface 12A of the housing 12, and the trace member 50 is in contact with the inner surface of the wall surface 12A of the housing 12 in a state having elastic force accumulated.

By this, during swaying of the trace member 50, a suitable degree of elastic force comes to be applied to the trace member 50 and movement of the trace member 50 is restricted so that the trace part 50A can assuredly circulate following the shape of the circulating cam groove 56.

Also, the interval between the front end surfaces of the trace parts 50A and 50B is made larger than the thickness of the thin part 52 so that the front end surfaces of the trace parts 50A and 50B do not contact the surface of the thin part 52. Therefore, the trace part 50A comes to move in circulation contacting the inner surface of the wall surface 12A of the housing 12 and the wall surface of the circulating cam groove 56, so that sliding resistance is not caused between the front end surfaces of the trace parts 50A and 50B and the surface of the thin part 52.

Also, as shown in FIG. 4(B), when the trace part 50A reaches the recessed part 54A of the cam part 54, the trace part 50A couples with that recessed part 54A and movement is stopped. This state is the locked state of the latch body 16, and the compression coil spring 38 comes to be held in a state having elastic force accumulated.

Figure 7:
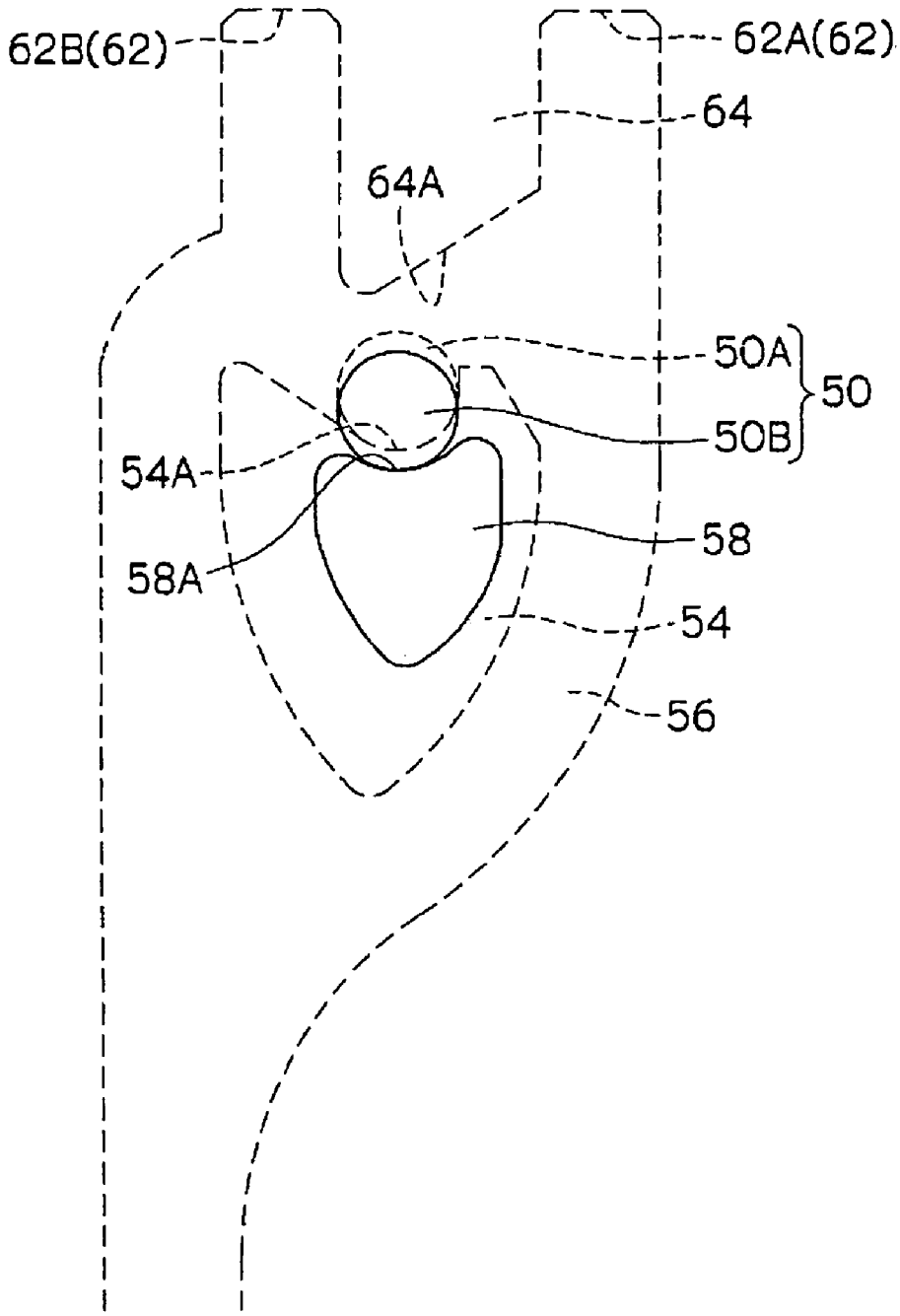
FIG. 7 is a plan view showing the coupled state of the circulating cam groove and the trace part of the latch device pertaining to a mode of working of the present invention.

Incidentally, as shown in FIG. 6, a slight gap t (here 0.15 mm) is provided between the recessed part 54A of the cam part 54 and the recessed part 58A of the protruding part 58 corresponding to that recessed part 54A viewing as a plane, and when a force toward the pulling-out direction is further applied to the latch body 16 in the locked state of the latch body 16, the trace member 50 is elastically deformed slightly, and as shown in FIG. 7 and FIG. 8(B), the trace part 50B contacts the recessed part 58A of the protruding part 58 so that the lock strength by the trace member 50 is increased.

Also, as shown in FIG. 4(A), when the locked state of the latch body 16 is released, the compression coil spring 38 having elastic force accumulated returns, the latch body 16 is pushed out from the housing 12, the gripping pieces 30 return, and they move away from each other (open).

Next, the operation of the latch device 10 pertaining to the mode of working is explained.

Figure 9:
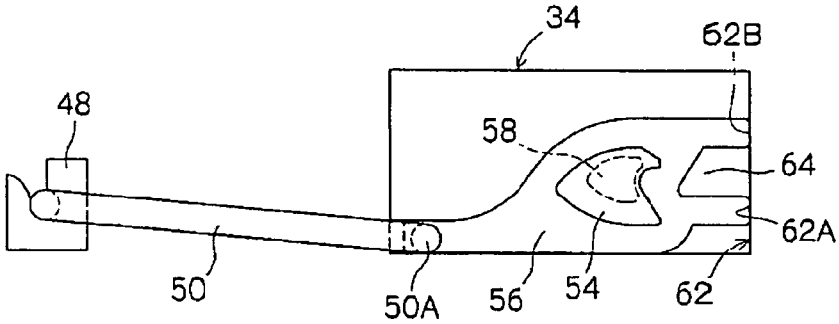
FIGS. 9(A)-9(H) are operational drawings for explaining the coupled state of the circulating cam groove and the trace part of the latch device pertaining to a mode of working of the present invention.
Figure 9:
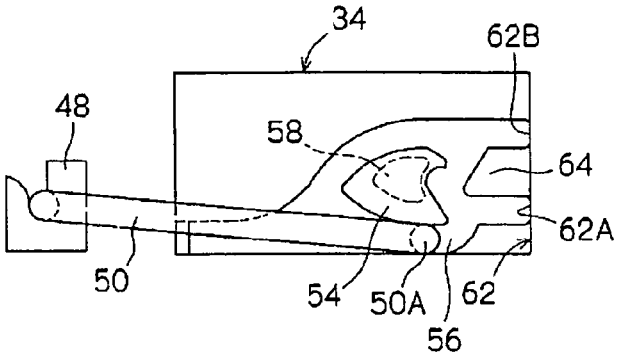
Figure 9:
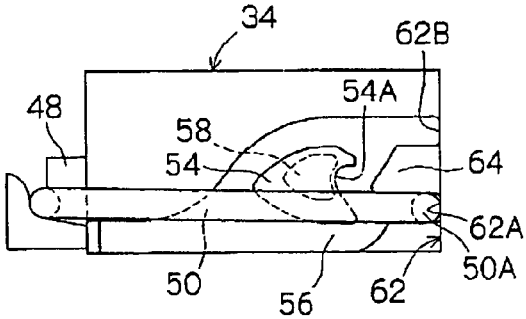
Figure 9:
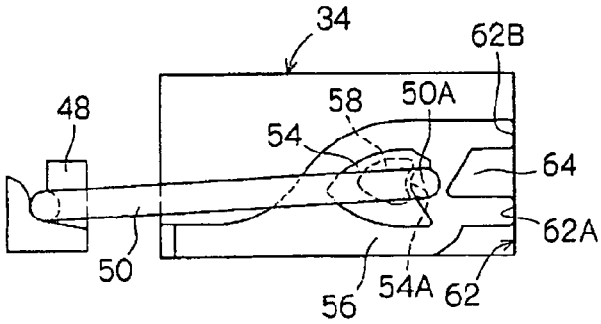
Figure 9:
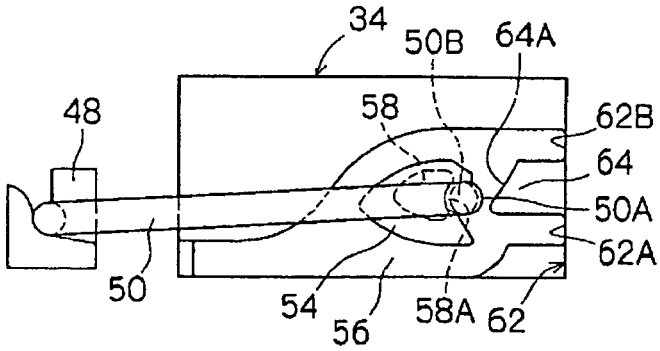
Figure 9:
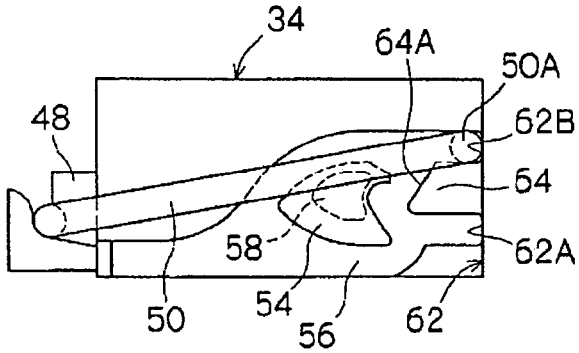
Figure 9:
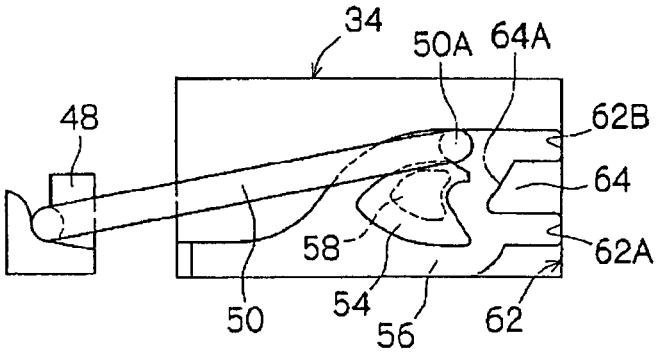
Figure 9:
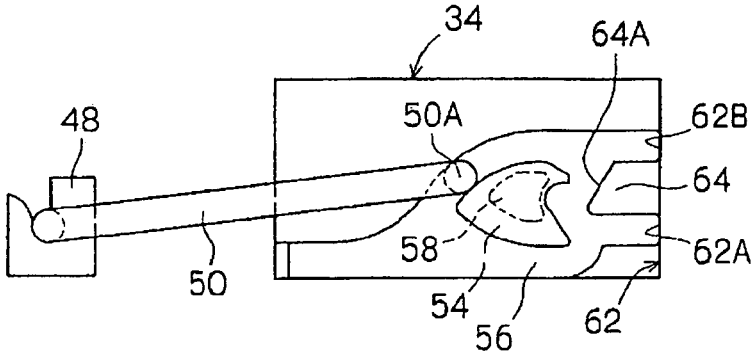

As shown in FIG. 4(A) and FIG. 9(A), when the latch body 16 is in the state having been pushed out from the housing 12, the trace part 50A of the trace member 50 is positioned in the entrance of the circulating cam groove 56, and the gripping pieces 30 provided on the front end part of the latch body 16 are in the expanded-diameter state apart from each other.

Meanwhile, as shown in FIG. 1, the attachment member 24 is received inside a box-shaped receiving body 60 to be capable of drawing out, and a striker 66 having an expanded-diameter part 66A formed on the front end part is provided toward the back of the receiving body 60. When the front surface of the attachment member 24 is pressed, the expanded-diameter part 66A presses the middle part between the gripping piece 30 and the gripping piece 30, and the latch body 16 is pushed into the housing 12. Thus, when the latch body 16 is pushed into the housing 12 (when it is pushed toward the direction opposing the force of the compression coil spring 38), the gripping pieces 30 are elastically deformed toward the direction of approaching each other, and the trace part 50A contacts the perimeter wall of the cam part 54, and as shown in FIG. 9(B), the trace part 50A comes to move while swaying inside the circulating cam groove 56 constituted by the perimeter wall of the cam part 54 and the inner surface of the housing 12.

Here, the trace member 50 is in contact with the inner surface of the wall surface 12A of the housing 12 in a state having elastic force accumulated, and a suitable degree of frictional force is applied to the trace member 50 during swaying of the trace member 50. By this, the movement of the trace member 50 is restricted, and the trace part 50A comes to circulate assuredly following the shape of the circulating cam groove 56. That is, the trace member 50 does not swing about freely.

Also, as shown in FIG. 9(C), when the trace part 50A contacts the stopper part 62A of the stopper wall 62, the latch body 16 comes to be restricted in movement, and the latch body 16 cannot be moved further toward the back of the housing 12.

In this state, when the pressing force on the latch body 16 is released, the latch body 16 is pressed toward the direction of being pulled out from the housing 12 by the returning force of the compression coil spring 38. By this, the trace part 50A contacts the perimeter wall of the cam part 54 facing opposite the stopper part 62A, and it is guided to the recessed part 54A following the shape of the perimeter wall. Also, as shown in FIG. 9(D), when the trace part 50A couples with the recessed part 54A, the latch body 16 becomes in the locked state.

Meanwhile, regarding the gripping piece 30, as shown in FIG. 4(B), the outside of the gripping piece 30 hits the rectangular frame 18, and the gripping piece 30 rotates toward the direction of approaching itself with the hinge part 32 as fulcrum. By this, the expanded-diameter part 66A of the striker 66 is gripped by the gripping piece 30, and it becomes in a state with the attachment member 24 being received inside the receiving body 60.

In this state, as shown in FIG. 6, a gap t is provided between the trace part 50B and the recessed part 58A of the protruding part 58. From this state, when a force toward the direction of pulling the attachment member 24 out from the receiving part 50 is applied (when a force toward the direction of pulling the latch body 16 out from the housing 12 is applied), the trace part 50 is elastically deformed, and as shown in FIG. 9(E) and FIG. 7, the trace part 50B couples with the recessed part 58A of the protruding part 58, and it is held in a state with the latch body 16 being locked by the trace part 50A and the trace part 50B.

Next, when the front surface of the attachment part 24 is pressed, the latch body 16 is pushed into the housing 12 by the expanded-diameter part 66A of the striker 66, and the locked state of the latch body 16 is released. Also, the trace part 50A contacts the cam wall 64, and is guided to the stopper part 62B following the cam surface 64A, and as shown in FIG. 9(F), the latch body 16 is restricted in movement in a state having the trace part 50A contacted to the stopper part 62B.

In this state, when the pressing force on the attachment part 24 is released (when the pressing force on the latch body 16 is released), the latch body 16 is pressed toward the direction of being pulled out from the housing 12 by the returning force of the compression coil spring 38, and as shown in FIGS. 9(G) and 9(H), the trace part 50A moves while swaying following the circulating cam groove 56 formed on the surface of the thin part 52, and as shown in FIG. 9(A), it returns to the entrance of the circulating cam groove 56, and as shown in FIG. 4(A), it becomes in a state having the latch body 16 pulled out from the housing 12.

At this time, the gripping pieces 30 of the latch body 16 become in a state expanded in diameter being apart from each other by the returning force of the hinge part 32, the gripping state on the expanded-diameter part 66A of the striker 66 is released, and the receiving body 60 can be pulled out from the attachment member 24.

Here, although it is not illustrated, a compression spring is provided between the receiving body 60 and the attachment member 24, and by making it so that the attachment member 24 is pressed, it can be made so that the attachment member 24 is automatically pushed out from the receiving body 60 by the returning force of the compression spring when the locked state of the latch body 16 is released.

Incidentally, in this mode, as shown in FIG. 6 and FIG. 7, by placing the protruding part 58 that can be contacted by the trace part 50B inside the cam part 54 and making it smaller than the external shape of the cam part 54 viewing as a plane, when the trace part 50A is circulating following the shape of the circulating cam groove 56, it is made such that the trace part 50B does not contact the protruding part 58, so that the trace part 50B is made to circulate in the same form as the circulating cam groove 56 together with the trace part 50A. Therefore, there is no occurrence of twisting force on the trace member.

Thus, because it is not the case that the trace part 50A is made to circulate by causing twisting force on the trace member 50, there is no requirement for high measurement precision in the shape of the cam groove 54, and the mold expense can be reduced. Also, because twisting force on the trace member 50 is not caused, the durability of the trace member 50 can be improved.

Furthermore, when the trace part 50A circulates following the shape of the circulating cam groove 56, because the trace part 50B does not contact the protruding part 58, it becomes that only roughly the same sliding resistance as in the case when only one trace part is used is caused, regardless of the fact that two trace parts 50A and 50B are being used.

Therefore, smooth operation can be obtained. Here, the groove width of the circulating cam groove 56 is made larger than the outer diameter measurement of the trace part 50A, and the sliding resistance acting on the trace part 50A is made smaller compared with the case when the groove width of the circulating cam groove 56 is made roughly the same as the outer diameter measurement of the trace part 56A.

Also, as shown in FIG. 7 and FIG. 8(B), in the locked state of the latch body 16, because the locked state of the latch body 16 can be held by the two trace parts 50A and 50B, by making it such that not only is the trace part 50A coupled with the recessed part 54A of the cam part 54, but also the trace part 50B is coupled with the recessed part 58A of the protruding part 58, the lock strength can be improved compared with the case when the locked state is held by one trace part.

As shown in FIG. 6, a gap "t" is provided between the recessed part 54A of the cam part 54 and the recessed part 58A of the protruding part 58. FIG. 7 illustrates the latch body 16 when a force, toward the direction of pulling the attachment member 24 out from the receiving body 60, is further applied from the normally locked state of the latch body 16. The trace part 50B couples with the recessed part 58A of the protruding part 58, and the locked state of the latch body 16 is held by the trace part 50A and the trace part 50B. In some embodiments, a gap "t" may not be provided. Therefore, it also may be made such that the locked state of the latch body 16 is held by the trace part 50A and the trace part 50B in the state having normally locked the latch body 16.

Also, the protruding part 58 was made roughly heart shaped, but it is not limited to this shape. Because it is 'sufficient if the trace part 50B becomes capable of contact only in the state having the trace part 50A coupled in the recessed part 54A, it is sufficient if a recessed part 58A being positioned inside the cam part 54 viewing as a plane and being capable of coupling with the trace part 50B is formed, for example, it also may be crescent shaped. Also, here, the trace member 50 was formed with metal, but it is not absolutely necessary to be metal.

Furthermore, in this mode, a latch device 10, having a latch body 16 inserted inside a housing 12 and is forced toward the pulling-out direction, is attached to the attachment member 24. However, the latch device 10 may, in other embodiments, be, attached to the receiving body 60, and the striker 66 may be attached to the attachment member 24.

Furthermore, although one embodiment of the lock mechanism may comprise a circulating cam groove 56 and a trace member 50, other embodiments are contemplated.

Figure 10:
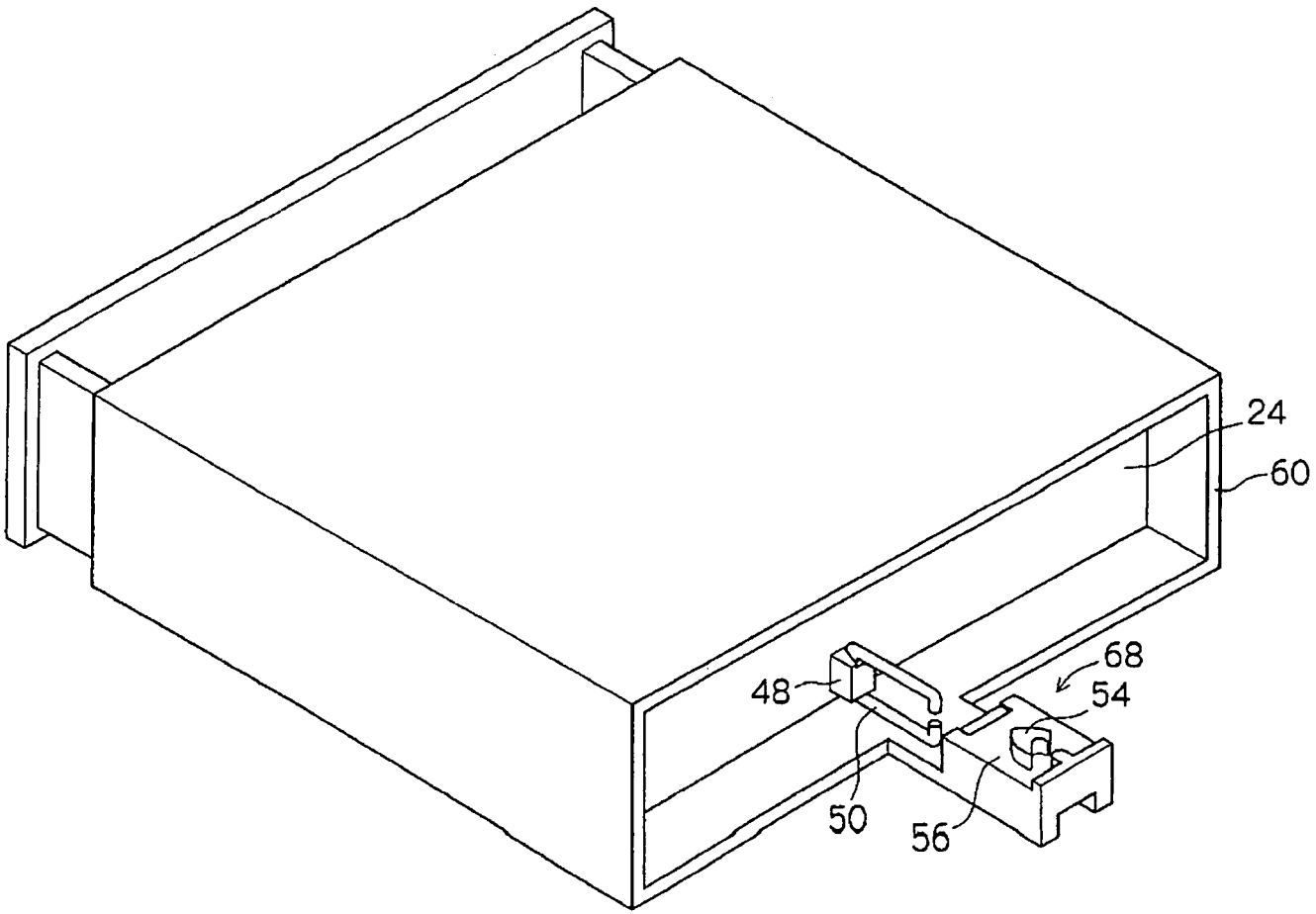
FIG. 10 is a perspective view showing a modified example of the circulating cam groove and the trace member pertaining to a mode of working of the present invention.

For example, as shown in FIG. 10, the trace member 50 may be attached directly to the attachment member 24 to be capable of swaying, and the a cam body 68 having a cam part 54 and a protruding part (not illustrated) formed may be provided on the receiving body 60. Also, although it is not illustrated, the cam body 68 may be provided on the attachment part 24, and the trace member 50 may be provided on the receiving body 60.

Here, in the case when the trace member 50 is not received inside the housing 12 (see FIG. 8(A)) and it in a state being exposed to the outside, the coupling state between the coupling part 48 holding the trace member 50 to be capable of swaying and the trace member 50 is made tighter so that frictional force is applied to the trace member 50 during swaying of the trace member 50. By this, the movement of the trace member 50 is restricted.

Figure 11:
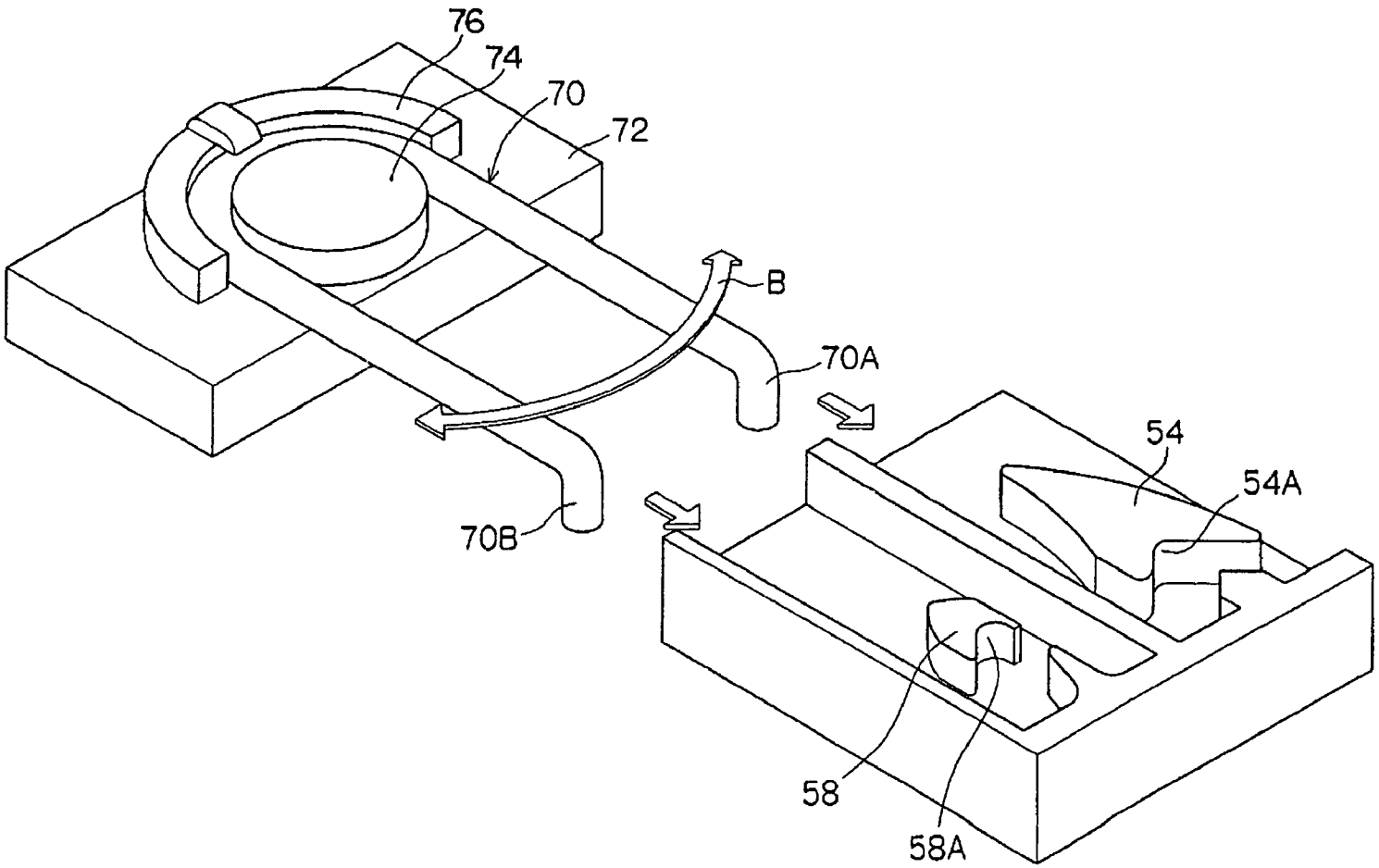
FIG. 11 is a perspective view showing another modified example of the circulating cam groove and the trace member pertaining to a mode of working of the present invention.

Furthermore, in this mode, the cam part 54 was placed protruding on one face of the thin part 52, and the protruding part 58 was placed protruding on the other face of the thin part 52, but as shown in FIG. 11, the cam part 54 and the protruding part 58 also may be placed in parallel.

In this case, a roughly U-shaped trace member 70 is used, and it is held by a holding member 72 so that it becomes capable of swaying toward the direction of arrow B. A boss 74 is provided on the holding member 72, and an arc-shaped arc rib 76 is provided roughly concentrically to the boss 74 with a gap between it and the outer perimeter of the boss 74. Although trace member 70 is coupled in the gap between this arc rib 76 and boss 74, the coupling state is made tighter so that frictional force is applied on the trace member 70 during swaying of the trace member 70. By this, the movement of the trace member 70 is restricted.

Also, the front end parts of the trace member 70 are bent and made as trace parts 70A and 70B. The distance of separation between the trace part 70A and the trace part 70B is held constant, the trace part 70A circulates following the cam part 54, and the trace part 70B moves accompanying the movement of the trace part 70A. Also, the trace part 70B first contacts with the protruding part 58 and becomes capable of coupling with the recessed part. 58A in the state with the trace part 70A coupled with the recessed part 54A of the cam part 54.

The disclosure of Japanese patent application No. 2005-141721 filed on May 13, 2005 is incorporated herein as a reference.

While the invention has been explained with reference to the specific embodiments of the invention, the explanation is illustrative and the invention is limited only by the appended claims.

What is claimed is:

1. A lock mechanism for a moving member capable of approaching and moving away from a main body, for holding said moving member immovably in a locked state and allowing movement in an unlocked state, said lock mechanism comprising:

a circulating cam groove formed on one of said main body and said moving member, and having a coupling part;

a trace member having a bracket with one trace part and another trace part and formed to be able to sway without twisting on the other of the main body and the moving member, said one trace part circulating along said circulating cam groove in each approaching and moving away operation of said moving member without applying bending and twisting forces to the other trace part, and locking the moving member in a state having coupled with the coupling part of the circulating cam groove; and a wall surface formed on said one of said main body and said moving member, and disposed in a different position from said circulating cam groove so that when the one trace part circulates along the circulating cam groove, said the other trace part does not contact the wall surface, and when the one trace part is coupled with the coupling part, said the other trace part of said trace member is able to contact the wall surfaces, wherein said circulating cam groove and the wall surface are arranged relative to the trace member such that when the one trace part engages the coupling part of the circulating cam groove, the other trace part is located with a predetermined distance away from a recessed part of the wall surface.

2. A lock mechanism according to claim 1, wherein the other trace part of said trace member contacts said wall surface when a force is further applied toward a direction moving said moving member away from said main body from the locked state of the moving member.

3. A lock mechanism according to claim 1, wherein said circulating cam groove is substantially heart shaped, and the coupling part of the circulating cam groove is a recessed part.

4. A lock mechanism according to claim 1, wherein said trace member is an elastically deformable metal pin.

5. A lock mechanism according to claim 1, wherein said wall surface has a shape similar to that of the circulating cam groove and smaller than the circulating cam groove.

6. A lock mechanism for a moving member capable of approaching and moving away from a main body, for holding said moving member immovably in a locked state and allowing movement in an unlocked state, said lock mechanism comprising:

a circulating cam groove formed on one of said main body and said moving member, and having a coupling part;

a trace member having a bracket with one trace part and another trace part and formed to be able to sway without twisting on the other of the main body and the moving member, said one trace part circulating along said circulating cam groove in each approaching and moving away operation of said moving member without applying bending and twisting forces to the other trace part, and locking the moving member in a state having coupled with the coupling part of the circulating cam groove; and a wall surface formed on said one of said main body and said moving member, and disposed in a different position from said circulating cam groove so that when the one trace part circulates along the circulating cam groove, said the other trace part does not contact the wall surface, and when the one trace part is coupled with the coupling part, said the other trace part of said trace member is able to contact the wall surface, wherein said circulating cam groove is substantially heart shaped, and the coupling part of the circulating cam groove is a recessed part, and said wall surface is substantially heart shaped smaller than the circulating cam groove.

7. A lock mechanism according to claim 6, wherein said circulating cam groove and said wall surface are arranged on one member to project in opposite dictions, and said wall surface is located inside the circulating cam groove when overlapping.

8. A latch device for a latch body capable of being inserted into a housing and being forced toward a pulling-out direction, comprising:

a circulating cam groove formed on one side of said latch body and having a coupling part;

a trace member having a bracket with one trace part and another trace part and formed to be able to sway without twisting on said housing, said one trace part circulating along said circulating cam groove in each pushing-in operation of the latch body without applying bending and twisting forces to the other trace part and locking the latch body in a locked state having coupled with the coupling part of the circulating cam groove; and a wall surface formed on the other side of said latch body, said wall surface being arranged such that when the one trace part circulates along the circulating cam groove, said the other trace part does not contact the wall surface, and when the one trace part is coupled with the coupling part, the other trace part of said trace member is able to contact the wall surfaces, wherein said circulating cam groove and the wall surface are arranged relative to the trace member such that when the one trace part engages the coupling part of the circulating cam groove, the other trace part is located with a predetermined distance away from a recessed part of the wall surface.

9. A latch device according to claim 8, wherein the other trace part of said trace member contacts said wall surface when a force is further applied toward a pulling-out direction of said latch body from the locked state of the latch body.

10. A latch device according to claim 8, wherein said circulating cam groove is roughly heart shaped, and said coupling part of the circulating cam groove is a recessed part.

11. A latch device according to claim 8, wherein said trace member is an elastically deformable metal pin.

12. A latch device according to claim 8, wherein said wall surface has a shape similar to that of the circulating cam groove and smaller than the circulating cam groove.

13. A lock mechanism, comprising:

a first member having a hole part;

a locking claw provided on the housing of the latch device according to claim 7 to be locked in the hole part of the first member;

gripping parts, which are capable of approaching and moving away from each other and formed on a front end part of the latch body of said latch device, said gripping parts forming a closed state when it is housed inside the housing in the locked state of the latch body, and forming an open state during unlocking of the latch body;

a second member arranged to relatively approach and move away from said first member; and a gripped part provided on said second member, said gripped part being gripped by said gripping parts in the locked state of the latch body, and being released from the gripped state of the gripping parts during unlocking.

* * * * *